US007651606B2

(12) United States Patent
Picard et al.

(10) Patent No.: US 7,651,606 B2
(45) Date of Patent: Jan. 26, 2010

(54) PROCESS FOR DESULPHURIZING OLEFINIC GASOLINES, COMPRISING AT LEAST TWO DISTINCT HYDRODESULPHURIZATION STEPS

(75) Inventors: Florent Picard, Communay (FR); Quentin Debuisschert, Rueil-Malmaison (FR); Annick Pucci, Croissy-sur-Seine (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 254 days.

(21) Appl. No.: 11/738,647

(22) Filed: Apr. 23, 2007

(65) Prior Publication Data

US 2007/0246399 A1 Oct. 25, 2007

(30) Foreign Application Priority Data

Apr. 24, 2006 (FR) ..... 06 03630

(51) Int. Cl.

| | |
|---|---|
| ***C10G 51/06*** | (2006.01) |
| ***C10G 47/00*** | (2006.01) |
| ***C10G 47/02*** | (2006.01) |
| ***C10G 45/60*** | (2006.01) |
| ***C07C 5/00*** | (2006.01) |
| ***C07C 5/373*** | (2006.01) |
| ***B01J 27/047*** | (2006.01) |

(52) U.S. Cl. ..... 208/210; 208/80; 208/107; 208/108; 208/209; 208/208 R; 208/78; 208/211; 208/213; 208/214; 208/217; 208/222; 585/250; 585/252; 585/300; 585/301; 585/302; 502/216; 502/219; 502/220; 502/221

(58) Field of Classification Search ..... 208/78, 208/80, 106, 107, 108, 134, 208 R, 209, 210, 208/213, 214, 216 R, 216 PP, 217, 211, 222, 208/218; 585/250, 252, 258, 259, 300, 301, 585/302; 502/216, 219, 220, 221
See application file for complete search history.

(56) References Cited

U.S. PATENT DOCUMENTS

| | | | | |
|---|---|---|---|---|
| 2,833,698 | A * | 5/1958 | Patton et al. | 208/89 |
| 2,938,857 | A * | 5/1960 | Johnson et al. | 208/89 |
| 3,050,457 | A * | 8/1962 | Wilson | 208/67 |
| 3,157,589 | A * | 11/1964 | Scott, Jr et al. | 208/80 |
| 3,224,958 | A * | 12/1965 | Schlinger | 208/78 |
| 3,265,610 | A * | 8/1966 | Lavergne et al. | 208/80 |
| 3,830,731 | A * | 8/1974 | Reeds, Jr. et al. | 208/211 |
| 3,902,991 | A * | 9/1975 | Christensen et al. | 208/211 |
| 3,954,673 | A * | 5/1976 | Morimoto | 502/314 |

(Continued)

FOREIGN PATENT DOCUMENTS

EP 1 002 853 A1 5/2000

*Primary Examiner*—Walter D Griffin
*Assistant Examiner*—Huy-Tram Nguyen
(74) *Attorney, Agent, or Firm*—Millen, White, Zelano, Branigan, P.C.

(57) ABSTRACT

The invention concerns a process for the hydrodesulphurization of gasoline cuts for the production of gasolines with a low sulphur and mercaptans content. Said process comprises at least two hydrodesulphurization steps, HDS1 and HDS2, operated in parallel on two distinct cuts of the gasoline constituting the feed. The flow rate of hydrogen in the hydrodesulphurization step HDS2 is such that the ratio between the flow rate of hydrogen and the flow rate of feed to be treated is less than 80% of the ratio of the flow rates used to desulphurize in the hydrodesulphurization step HDS1.

13 Claims, 3 Drawing Sheets

U.S. PATENT DOCUMENTS 3,968,026 A * 7/1976 Frayer et al. ..... 208/210
4,006,076 A * 2/1977 Christensen et al. ..... 208/211
4,017,380 A * 4/1977 Byler et al. ..... 208/89
4,062,762 A * 12/1977 Howard et al. ..... 208/211
4,116,816 A * 9/1978 Davis et al. ..... 208/209
4,131,537 A * 12/1978 Winter et al. ..... 208/216 PP
4,397,739 A * 8/1983 Jacquin et al. ..... 208/210
4,576,710 A * 3/1986 Nongbri et al. ..... 208/58
4,844,791 A * 7/1989 Moorehead ..... 208/111.3
4,844,792 A * 7/1989 Abdo et al. ..... 208/111.3
4,885,080 A * 12/1989 Brown et al. ..... 208/218
4,990,242 A * 2/1991 Louie et al. ..... 208/218
5,837,130 A * 11/1998 Crossland ..... 208/213
5,954,946 A * 9/1999 Klazinga et al. ..... 208/111.01
6,103,105 A * 8/2000 Cooper et al. ..... 208/210
6,165,348 A * 12/2000 Morel et al. ..... 208/15
6,306,287 B1 * 10/2001 Billon et al. ..... 208/211
6,334,948 B1 * 1/2002 Didillon et al. ..... 208/218
6,596,157 B2 * 7/2003 Gupta et al. ..... 208/210
6,620,311 B2 * 9/2003 Morel et al. ..... 208/57
6,623,627 B1 * 9/2003 Zhou ..... 208/208 R
6,830,678 B2 * 12/2004 Didillon et al. ..... 208/211
6,838,060 B1 * 1/2005 Chapus et al. ..... 422/190
2001/0027936 A1 * 10/2001 Morel et al. ..... 208/57
2001/0050244 A1 * 12/2001 Didillon et al. ..... 208/97
2004/0045869 A1 * 3/2004 Benazzi et al. ..... 208/59

* cited by examiner

PROCESS FOR DESULPHURIZING OLEFINIC GASOLINES, COMPRISING AT LEAST TWO DISTINCT HYDRODESULPHURIZATION STEPS

FIELD OF THE INVENTION

The invention relates to a process for producing gasolines with a low sulphur and mercaptans content, which comprises at least two hydrodesulphurization steps operated in parallel on two distinct gasoline cuts. Said process optionally comprises a single hydrogen purification and recycling section. A hydrodesulphurization step corresponds to one or more hydrodesulphurization sections. A hydrodesulphurization section corresponds to one or more beds.

DESCRIPTION OF THE PROBLEM

The production of fuel for gasoline or diesel engines satisfying new environmental standards requires in particular that their sulphur content be substantially reduced. Environmental specifications constrain refiners to reduce the amount of sulphur in the gasoline and gas oil pool to values of at most 50 ppm in 2005 and to at most 10 ppm on the first of January 2009 within the European community.

The feed to be treated is generally a gasoline cut containing sulphur, such as a gasoline cut from a coking unit, visbreaking unit, steam cracking or catalytic cracking unit (FCC). Said feed is preferably constituted by a gasoline feed from a catalytic cracking unit the distillation range of which is in the range 0° C. to 300° C., preferably in the range 0° C. to 250° C. In the remainder of the text, we shall speak in general of catalytically cracked gasoline, broadening this definition to gasolines which may, in addition to a catalytically cracked gasoline portion, contain gasoline fractions from other conversion units.

The catalytically cracked gasolines may constituted 30% to 50% by volume of the gasoline pool and generally have high mono-olefin and sulphur contents. However, almost 90% of the sulphur present in reformed gasoline is attributable to the gasoline from catalytic cracking. Gasoline desulphurization, and principally FCC gasolines, is thus of crucial importance in hitting current and future specifications. However, the mono-olefins contained in the gasoline make a major contribution to their octane number. To keep the octane number of gas from olefinic cracking high, it is necessary to limit the degree of hydrogenation of mono-olefins during hydrodesulphurization treatment of the gasolines. Selective hydrodesulphurization processes were developed for this purpose.

Further, desulphurized gasolines must also satisfy the specifications as regards corrosive power. The corrosive power of gasolines is essentially due to the presence of acidic sulphur-containing compounds such as mercaptans. The desulphurized gasolines must thus contain few mercaptans to limit their corrosivity. However, it is now known that in units for selective hydrodesulphurization of olefinic gasolines, $H_2S$ present in the reactor may react with the non-hydrogenated mono-olefins to form mercaptans. The fraction of mercaptans in the gasoline produced is generally higher when the sulphur content of the gasoline is lower. To minimize the mercaptans content, it is generally preferable to operate with a high hydrogen flow rate. However, this involves high costs related to the compressor, recycling and hydrogen purification. To overcome this problem, the present invention presents a solution which can limit the energy consumption of the compressor, while reducing the mercaptans content and increasing the octane number for a constant sulphur content in the desulphurized gasoline.

Further, in contrast, changes in the worldwide automotive market have forced refiners to investigate the maximum flexibility and thus the possibility of maximizing production of gas oil for diesel-engined vehicles or the production of gasoline, depending on the circumstances. Thus, it may be highly advantageous for a refiner to have at his disposal the cheapest possible option of sending the heavy gasoline fraction either to the gasoline pool or to the middle distillates pool, as required.

In summary, the present invention proposes a novel solution for economically solving the three-fold problem of reducing the sulphur content in fuels, limiting the mercaptans content in low sulphur gasolines and flexibility of orientation of the production of fuel towards gasoline cuts or middle distillates, depending on market requirements. Further, in the current context of reducing greenhose gas emissions, it is important to integrated into any novel idea the problem of controlling energy consumption. The process described in the context of the present invention is innovative as it allows simultaneous treatment of the three-fold problem described above while limiting the energy consumption due to the necessary compression of the hydrogen which is recycled to the hydrodesulphurization steps. Gasolines are obtained with a research octane number (RON) and sulphur content (S) which are such that RON≧90.70 and [S]≦50 ppm, preferably RON≧90.70 and [S]≦37 ppm, more preferably RON≧90.75 and [S]≦35 ppm and more preferably RON≧90.80 and [S]≦31 ppm. Preferably, each pair is associated with a motor octane number (MON) such that MON≧79.45, preferably MON≧79.50 and more preferably MON≧79.55.

Examination of the Prior Art

European patent application EP-A1-0 725 126 describes a method for desulphurizing catalytically cracked gasolines while limiting the octane number loss through mono-olefin hydrogenation. That method consists of distilling the gasoline into several fractions, including at least one fraction which is rich in compounds which are difficult to desulphurize selected from thiophene and alkylthiophenes, and a fraction which is rich in compounds which are easy to desulphurize, selected from thiacyclopentane, alkylthiacyclopentanes, benzothiophene and alkylbenzothiophenes. At least one of those two fractions is treated by a hydrodesulphurization process and then mixed with the untreated fraction.

That method has the disadvantage of necessitating an analysis of the different fractions before treatment, and does not describe how to select the fractions to limit the quantity of mercaptans in the final desulphurized product.

United States patent U.S. Pat. No.-B2-6,596,157 describes a process for desulphurizing gasoline cuts from cracking units, based on the treatment, in parallel, of the heavy fraction of the gasoline termed HCN (heavy cat naphtha) under hydrodesulphurization conditions which are non-selective and of the intermediate fraction of the gasoline termed ICN (intermediate cat naphtha) under selective hydrodesulphurization conditions, wherein the intermediate gasoline (ICN) is heated by the hydrotreated heavy fraction (HCN).

That patent does not describe how to treat the various cuts to limit the fraction of sulphur-containing compounds in the form of mercaptans in the desulphurized gasoline. Further, according to the disclosure of that patent, the light fraction of the gasoline, termed LCN (light cat naphtha), must generally undergo a complementary desulphurization treatment, for example extracting mercaptans by washing using a solution containing sodium hydroxide.

Regarding the. problem of extracting mercaptans in desulphurized cracking gasolines, the current solutions described in U.S. Pat. No. 6,960,291 consist of post-treating gasolines from selective hydrotreatment to deplete them in mercaptans. Many methods have been envisaged. As an example, we can cite WO-A-01/79391, which describes methods for treating partially desulphurized gasolines to reduce the mercaptans content using various methods such as adsorption, extraction with sodium hydroxide, heat treatments, etc. However, those methods have the disadvantage that they necessitate the use of a supplemental step for treating the gasoline and do not have the flexibility of sending certain cuts either to the gasoline pool or to the middle distillates pool.

US-A-2003/0042175 describes a method for desulphurizing cracking gasolines comprising various treatment steps to reduce the sulphur content. That process comprises a diolefins hydrogenation step, a step for the transformation of light sulphur-containing compounds by weighting, a step for distilling the gasoline into several cuts and at least one step for desulphurization of at least a portion of the heavy fraction of the gasoline produced. However, that patent does not disclose how to treat the gasolines to minimize the mercaptans content in the desulphurized gasoline, nor how to treat the hydrogen from the hydrodesulphurization steps.

Description of the Invention

The invention is based on the differential treatment of the various cuts constituting the gasoline cut.

It is known that in catalytically cracked gasolines, the light fractions are rich in mono-olefins and in saturated sulphur-containing compounds such as mercaptans and sulphides. The term "light fraction" means gasoline fractions with a boiling point of less than 100° C., preferably less than 80° C. and more preferably less than 65° C. The heavy fraction of the gasoline is rich in benzothiophene type sulphur-containing compounds such as benzothiophene and alkyl benzothiophenes and to a lesser degree, it is rich in alkyl thiophenes. Further, it is rich in aromatic compounds and poor in olefinic compounds. The heavy fraction of the gasoline is constituted by hydrocarbons with a boiling point of more than 160° C., preferably more than 180° C. and more preferably more than 207° C. That heavy fraction of the gasoline is generally that which contains the most sulphur. The heavy fraction of the gasoline may be incorporated either into the gasoline pool or into the middle distillates fraction to produce kerosenes or gas oils. The core fraction corresponds to the intermediate fraction between the light fraction and the heavy fraction. The core fraction of the gasoline is rich in mono-olefins and in sulphur-containing thiophene type compounds, including thiophene, methyl thiophenes and other alkyl thiophenes.

In general, the various fractions of the gasoline are obtained by distilling the effluent from the catalytic cracking unit.

The mixture constituted by the light fraction of the gasoline and the intermediate fraction or the intermediate fraction alone is treated in a first hydrodesulphurization step denoted HDS 1. This step comprises bringing the gasoline to be treated into contact with hydrogen in one or more hydrodesulphurization reactors in series, containing one or more suitable catalysts for carrying out selective hydrodesuiphurization, i.e. with a degree of mono-olefins hydrogenation of less than 60%, preferably less than 50% and more preferably less than 40%.

The operating pressure in this step is generally in the range 0.5 MPa to 5 MPa, and preferably in the range 1 MPa to 3 MPa. The temperature is in the range 200° C. to 400° C. and preferably in the range 220° C. to 380° C. In the case in which the treatment is carried out in a plurality of reactors in series, the mean operating temperature of each reactor is greater by at least 5° C., preferably by at least 10° C. and more preferably by at least 15° C. than the operating temperature of the preceding reactor.

The quantity of catalyst used in each reactor is such that the ratio between the flow rate of the gasoline to be treated, expressed in $m^3$ per hour under standard conditions, per $m^3$ of catalyst (also termed the hourly space velocity) is in the range 0.5 $h^{-1}$ to 20 $h^{-1}$, preferably in the range 1 $h^{-1}$ to 15 $h^{-1}$. Most preferably, the first reactor is operated with an hourly space velocity in the range 2 $h^{-1}$ to 8 $h^{-1}$.

The hydrogen flow rate is such that the ratio between the hydrogen flow rate, expressed in normal $m^3$ per hour (Nm3/h) and the flow rate of the feed to be treated, expressed in $m^3$ per hour under standard conditions, is in the range 50 $Nm^3/m^3$ to 1000 $Nm^3/m^3$, preferably in the range 70 $Nm^3/m^3$ to 800 $Nm^3/m^3$.

The degree of desulphurization achieved during the HDS1 step is generally more than 80% and preferably more than 90%.

After the hydrodesulphurization step, the reaction mixture is cooled to a temperature of less than 60° C. to condense the hydrocarbons. The gas and liquid phases are separated in a separator. The liquid fraction which contains the desulphurized gasoline and a fraction of the dissolved $H_2S$ is sent to a stripping section; the gas fraction, which is principally constituted by hydrogen and which contains the majority of the $H_2S$, is sent to a purification section.

The heavy fraction of the gasoline is treated in a distinct hydrodesulphurization step denoted HDS2. This step comprises bringing the gasoline to be treated in contact with hydrogen in one or more hydrodesulphurization reactors in series containing one or more suitable catalysts for carrying out hydrodesulphurization. Preferably, hydrodesulphurization of the heavy gasoline is carried out in a single step, on a single reactor. Hydrodesulphurization may be carried out selectively or non-selectively. In the first case, the degree of hydrogenation of the mono-olefins is less than 90%, preferably less than 80% and more preferably less than 60%.

The operating pressure in this step is generally in the range 0.5 MPa to 10 MPa, preferably in the range 1 MPa to 8 MPa. The temperature is in the range 220° C. to 450° C. and preferably in the range 250° C. to 380° C. In the case in which the treatment is carried out in a plurality of reactors in series, the mean operating temperature in each reactor is greater by at least 5° C., preferably by at least 10° C. and more preferably by at least 15° C. than the operating temperature of the preceding reactor.

The quantity of catalyst employed in each reactor is such that the ratio between the flow rate of the gasoline to be treated, expressed in $m^3$ per hour under standard conditions, per $m^3$ of catalyst (also termed the hourly space velocity) is in the range 0.3 $h^{-1}$ to 20 $h^{-1}$, preferably in the range 0.5 $h^{-1}$ to 15 $h^{-1}$. More preferably, the first reactor is operated with an hourly space velocity in the range 1 $h^{-1}$ to 8 $h^{-1}$.

The hydrogen flow rate is such that the ratio between the flow rate of hydrogen, expressed in normal $m^3$ per hour (N $m^3/h$) and the flow rate of the feed to be treated, expressed in $m^3$ per hour under standard conditions, is in the range 30 N $m^3/m^3$ to 800 N $m^3/m^3$, preferably in the range 50 N $m^3/m^3$ to 500 N $m^3/m^3$. Preferably, this ratio is less than 80% of the ratio of the flow rates employed for desulphurization in hydrodesulphurization step HDS1, preferably less than 60%, more preferably less than 50% and still more preferably less than 40% of the ratio of the flow rates employed for desulphurization in the hydrodesulphurization step HDS1.

After the hydrodesulphurization step, the reaction mixture is cooled to a temperature of less than 60° C. to condense the hydrocarbons. The gas and liquid phases are separated in a separator. The liquid fraction which contains the desulphurized gasoline as well as a fraction of dissolved $H_2S$ is sent to a stripping section; the gaseous fraction principally constituted by hydrogen and which contains the majority of $H_2S$, is sent to a purification section.

Any catalyst with good selectivity as regards hydrodesulphurization reactions may be used in steps HDS1 or HDS2. As an example, catalysts are used comprising an amorphous porous mineral support selected from the group constituted by aluminas, silicon carbide, silica, silica-aluminas or titanium or magnesium oxides, used alone or as a mixture with the alumina or the silica-alumina. It is preferably selected from the group constituted by silica, the family of transition aluminas and silica-aluminas. Highly preferably, the support is essentially constituted by at least one transition alumina, i.e. it comprises at least 51% by weight, preferably at least 60% by weight, more preferably at least 80% by weight, or even at least 90% by weight of transition alumina. It may optionally be solely constituted by a transition alumina.

The specific surface area of the support is generally below 200 $m^2/g$ and preferably less than 150 $m^2/g$. The porosity of the catalyst before sulphurization is such that it has a mean pore diameter of more than 20 nm, preferably more than 25 nm or even 30 nm and usually between 20 and 140 nm, preferably between 20 nm and 100 nm, and highly preferably between 25 and 80 nm. The pore diameter is measured by mercury porosimetry in accordance with the ASTM D4284-92 standard with a wetting angle of 140°.

The hydrodesulphurization catalyst contains at least one group VI metal and/or at least one group VIII metal on a support. The group VI metal is generally molybdenum or tungsten; the group VIII metal is generally nickel or cobalt. In accordance with the invention, the surface density of the group VI metal is in the range $2\times104^{-4}$ to $4.0\times10^{-3}$ grams of oxide of said metal per $m^2$ of support, preferably in the range $4\times10^{-4}$ to $1.6\times10^{-3}$ $g/m^2$.

Highly preferably, a catalyst or a concatenation of catalysts as described in patent application US2006000751A1 is used. They are catalysts comprising a support selected, for example, from refractory oxides such as aluminas, silicas, silica-aluminas or magnesia, used alone or as a mixture, and a group VI metal, preferably molybdenum or tungsten which may or may not be promoted by a group VIII metal, preferably cobalt or nickel. Said catalysts have a mean pore diameter of more than 22 nm. In the optional case of a concatenation of catalysts, the process comprises a succession of hydrodesulphurization steps, such that the activity of the catalyst in a step n+1 is in the range 1% to 90% of the activity of the catalyst in step n.

However, it is possible to use a non-selective catalyst in step HDS2. As an example, catalysts are used comprising a porous amorphous mineral support selected from the group constituted by aluminas, silicon carbide, silica, silica-aluminas or titanium or magnesium oxides, used alone or as a mixture with alumina or silica-alumina. It is preferably selected from the group constituted by silica, the transition alumina family and silica-aluminas. Highly preferably, the support is essentially constituted by at least one transition alumina, i.e. it comprises at least 51% by weight, preferably at least 60% by weight, more preferably at least 80% by weight, or even at least 90% by weight of transition alumina. It may optionally be solely constituted by a transition alumina. The hydrodesulphurization catalyst contains at least one group VI metal and/or at least one group VIII metal on a support. The group VI metal is generally molybdenum or tungsten and the group VIII metal is generally nickel or cobalt. The selective or non-selective nature of the hydrodesulphurization catalyst as defined above in the description of the invention generally depends on the composition and the mode of preparation of said catalyst. Simple ways of varying the selectivity consist, for example, of modifying the amounts of group VIII and group VI meals or optionally the mole ratio between the quantities of the group VIII and group VI metals for a given support or varying the specific surface area of the support for constant amounts of metals.

In a preferred implementation of the invention, the excess hydrogen from the hydrodesulphurization steps HDS1 and HDS2 may be combined and treated in a single purification section. The purified hydrogen is then recycled to at least one of the hydrodesulphurization steps HDS1 and HDS2 after a compression step to compensate for the pressure drops across the process. a makeup of fresh hydrogen is carried out either before or after the compression step to compensate for the consumption of hydrogen in the hydrodesulphurization reactors.

It is possible to envisage admitting at least all of the hydrogen necessary for the reactions occurring in the two hydrodesulphurization steps through a single one of the hydrodesulphurization steps, preferably HDS2. To this end, the whole supply of hydrogen necessary for steps HDS1 and HDS2 is thus sent to just one of these steps, preferably HDS2, and the gas purge from this step is sent to the purification treatment from which the purified gaseous product is recycled only to the other hydrodesulphurization step. That type of layout can minimize the flow rate of recycled hydrogen passing via the compressor in the case in which all of the hydrogen consumed in the two hydrodesulphurization steps is sent through the HDS2 unit and the gas purge from this unit is sent to the purification treatment where the gas purified product is only recycled to the HDS1 step. Since the HDS1 unit necessitates a lower hydrogen flow rate compared with the HDS2 unit, less hydrogen needs to be recycled via the compressor and hence the energy consumption of the compressor is reduced.

It is possible to envisage a combined treatment of the vapour fractions from the two stripping columns dedicated to each hydrodesulphurization step (cooling, recycling the condensed liquid to each of the stripping and purge columns combined with $H_2S$ rich gas sent to a purification step).

In the case in which the product from the hydrodesulphurization step HDS2 is sent to the diesel pool, the fact of providing a HDS2 step dedicated to the heavy gasoline means that this gasoline cannot be co-mixed with middle distillate cuts in another hydrotreatment step and thus releases the capacity in said hydrotreatment step, and as a result increases the capacity of the refinery production.

While remaining within the context of the invention, it is possible to carry out a pre-treatment of the feed the principal aim of which is:

selectively hydrogenating the diolefins to mono-olefins;

transforming the light saturated sulphur-containing compounds, principally mercaptans, into heavier sulphides or mercaptans by reaction with the mono-olefins.

The hydrogenation of diolefins to mono-olefins is illustrated below by the transformation of 1,3-pentadiene, which is an unstable compound which polymerizes easily into pent-2-ene by addition of hydrogen. However, secondary mono-olefin hydrogenation reactions must be limited since, as shown in the example below, they would result in the formation of n-pentane.

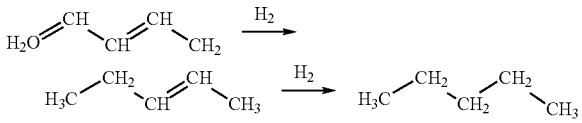

The sulphur-containing compounds which are to be transformed are principally mercaptans and sulphides. The principal mercaptan transformation reaction consists of thioetherification of mono-olefins by mercaptans. This reaction is illustrated below by the addition of propane-2-thiol to pent-2-ene to form a propylpentylsulphide.

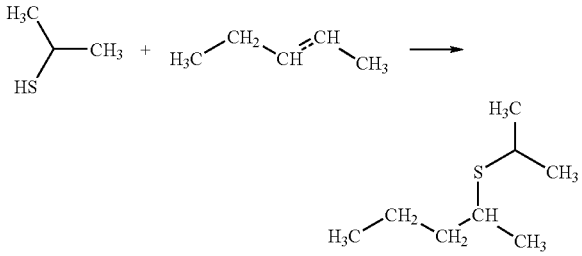

In the presence of hydrogen, sulphur-containing compound transformation may also be carried out by the intermediate formation of hydrogen sulphide which may then add to the unsaturated compounds present in the feed. However, this is a minor pathway under the preferred reaction conditions.

In addition to mercaptans, the compounds which may be transformed into heavier compounds are sulphides, principally dimethylsulphide, methylethylsulphide and diethylsulphide, $CS_2$, COS, thiophane and methylthiophane.

In certain cases, it is also possible to observe reactions for transforming light nitrogen-containing compounds, principally nitrites, pyrrole and its derivatives, into heavier compounds.

This pre-treatment step consists of bringing the feed to be treated into contact with a stream of hydrogen and catalyst containing at least one metal from group VIB (group 6 in the new periodic table notation: Handbook of Chemistry and Physics, 76$^{th}$ edition, 1995-1996) and at least one non-noble group VIII metal (groups 8, 9 and 10 of said classification), deposited on a porous support.

The catalyst of the invention may be prepared using any technique which is known to the skilled person, in particular by impregnating elements from groups VIII and VIB onto the selected support. Said impregnation may, for example, be carried out using the preparation technique known to the skilled person as dry impregnation, in which exactly the desired quantity of elements is introduced in the form of salts which are soluble in the selected solvent, for example demineralized water, to fill the porosity of the support as exactly as possible. The support, which is by then filled with solution, is preferably dried. The preferred support is alumina, which may be prepared from any type of precursor and shaping tools which are known to the skilled person.

The catalyst is normally used in a sulphurized form obtained after treatment at temperature in contact with a decomposable sulphur-containing organic compound which can generate hydrogen sulphide ($H_2S$), or directly in contact with a flow of gaseous $H_2S$ diluted in $H_2$. This step may be carried out in situ or ex situ (i.e. inside or outside the hydrodesulphurization reactor) at temperatures in the range 200° C. to 600° C. and more preferably in the range 300° C. to 500° C.

The feed to be treated is mixed with hydrogen before being brought into contact with the catalyst. The quantity of hydrogen which is injected is such that the mole ratio between the hydrogen and the diolefins to be hydrogenated is more than 1 (stoichiometry) and less than 10, preferably in the range 1 to 5 mol/mol. Too large an excess of hydrogen may cause too much hydrogenation of mono-olefins and as a result, reduce the octane number of the gasoline. The whole feed is generally injected into the reactor inlet. However, it may be advantageous in some cases to inject a fraction or all of the feed between two consecutive catalytic beds placed in the reactor. This implementation can allow the reactor to continue operating if the inlet to the reactor is blocked with deposits of polymers, particles or gums present in the feed.

The mixture constituted by gasoline and hydrogen is brought into contact with the catalyst at a temperature in the range 80° C. to 220° C., preferably in the range 90° C. to 200° C. a liquid hourly space velocity (LHSV) in the range 1 $h^{-1}$ to 10 $h^{-1}$, the units for the liquid hourly space velocity being a litre of feed per litre of catalyst per hour (l/l.h) The pressure is adjusted so that the reaction mixture is mainly in the liquid form in the reactor. The pressure is in the range 0.5 MPa to 5 MPa and is preferably in the range 1 to 4 MPa.

The gasoline treated under the conditions mentioned above has a reduced diolefins and mercaptans content. Generally, the gasoline produced contains less than 1% by weight of diolefins and preferably less than 0.5% by weight of diolefins. The amount of light sulphur-containing compounds with a boiling point lower than that of thiophene (84° C.) which is generally converted is more than 50%. Thus, it is possible to separate the light fraction of the gasoline by distillation and to send said fraction directly to the gasoline pool without complementary treatment.

BRIEF DESCRIPTION OF DRAWINGS

The preferred implementations of the process of the present invention are illustrated in the flowsheets of FIG. 1, FIG. 2 and FIG. 3.

Description of FIG. 1

Figure 1:
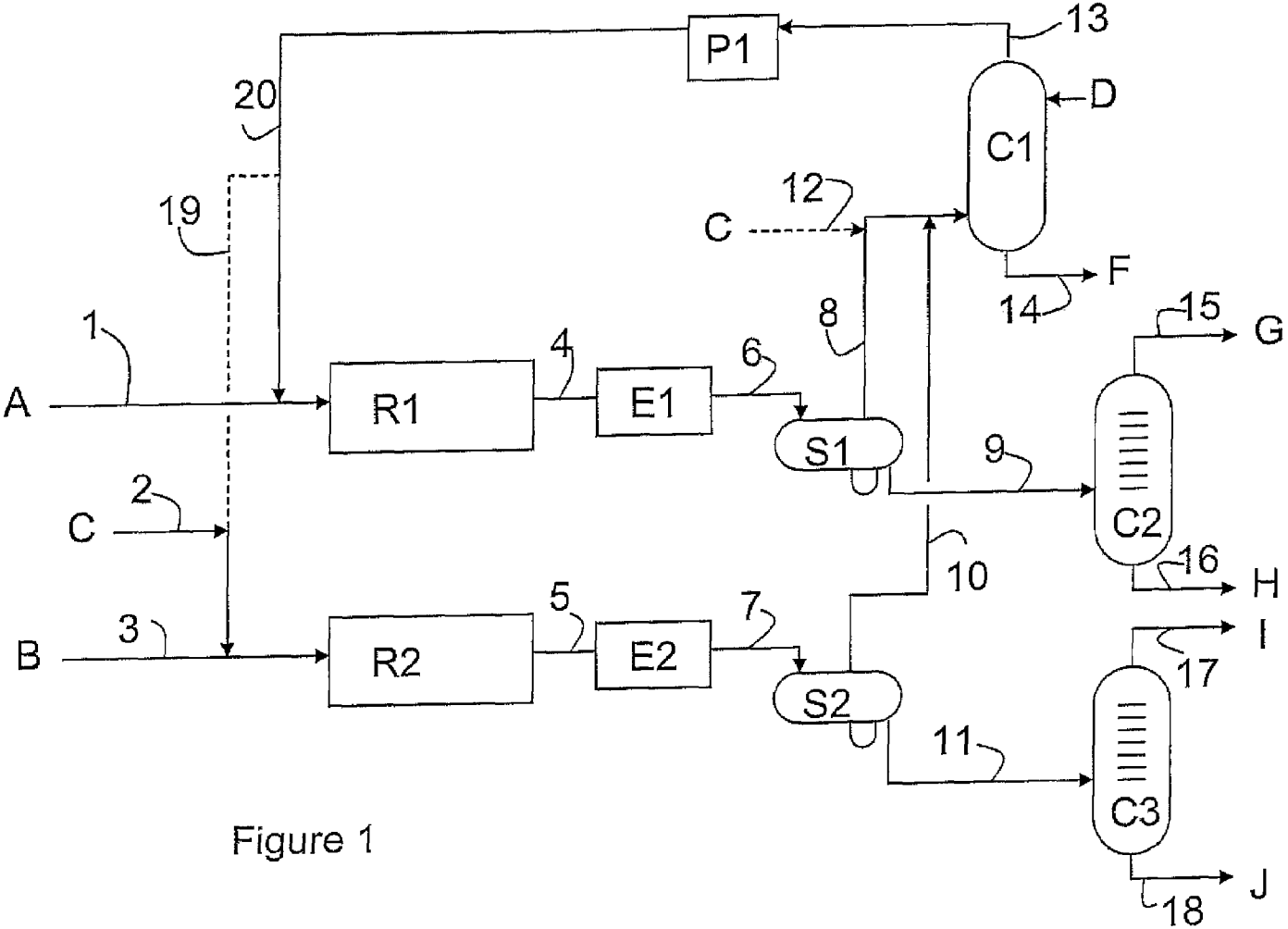

A core gasoline, gasoline A, moving in line 1 was mixed with hydrogen from a recycled compressor P1 via line 20. The mixture so formed is injected into the reaction section R1. The effluent moving via line 4 is cooled in the exchanger section E1 to condense the hydrocarbons then the mixture is injected into the separation section S1 via a line 6. The separation section S1 produces a gaseous fraction extracted via a line 8 which is essentially constituted by hydrogen, $H_2S$ and light hydrocarbons and a liquid fraction extracted via a line 9. The liquid fraction is then injected into a stabilization section C2 which extracts $H_2S$ dissolved in the hydrocarbons via an overhead line 15. The gasoline recovered from the bottom of column C2 via a line 16 may be sent directly to the gasoline pool.

A heavy gasoline, gasoline B, moving in line 3 is mixed with fresh hydrogen supplied via a line 2. The mixture so constituted is injected into the reaction section R2. The effluent moving via line 5 is cooled in the exchanger section E2 to condense the hydrocarbons, then the mixture is injected into the separation section S2 via a line 7. The separation section S2 produces a gas fraction, extracted via line 10, which is essentially constituted by hydrogen, $H_2S$ and light hydrocarbons, and a liquid fraction is extracted via a line 11. The liquid fraction is then injected into a stabilization section C3 which extracts the $H_2S$ dissolved in the hydrocarbons via an overhead line 17. The heavy desulphurized gasoline recovered via a line 18 may be sent either to the gasoline pool or to the middle distillates pool.

The stabilization sections C2 and C3 each comprise a distillation column. To limit the operating costs and investment costs, it is advantageous to combine the distillates from said two columns before cooling them to condense them and to send them together to a reflux drum. The two columns may then be operated with a common reflux section.

The hydrogen from separators S1 and S2 respectively via lines 8 and 10 are mixed before being treated in a common purification section C1, which consists of washing with an aqueous amine solution using a well known technique. After purification, the hydrogen, free of $H_2S$, moving in line 13 and compressed in a recycle compressor P1, is then mixed with gasoline A via line 20.

In a further variation of the invention, makeup hydrogen is injected via a line 12 upstream of the purification section C1. The hydrogen necessary for treatment of gasoline B is then injected via a line 19 into the hydrodesulphurization step of the reaction section R2.

Figure 2:
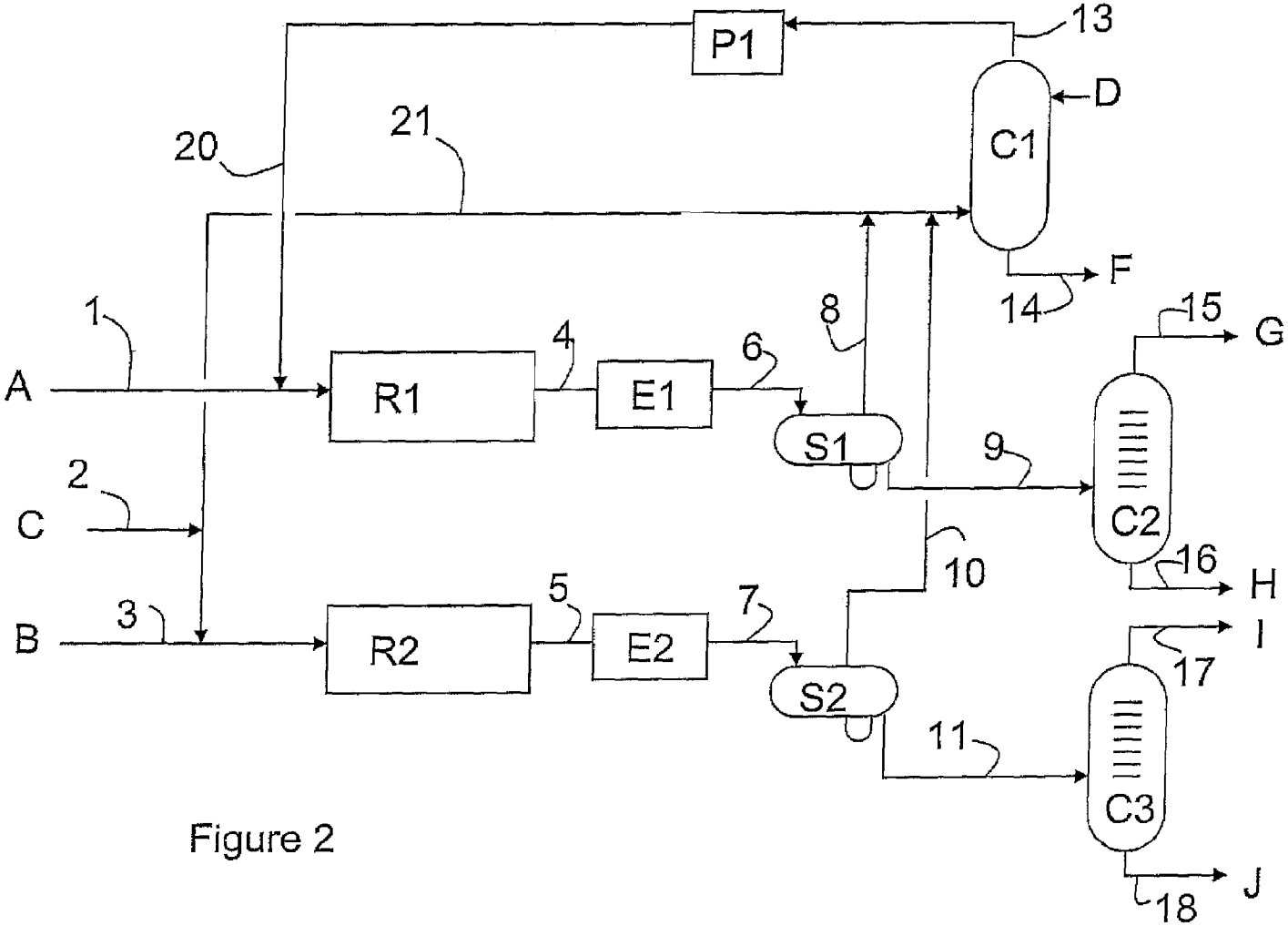

Description of FIG. 2

The numbers used in this Figure correspond to those used for FIG. 1.

A further variation of the invention is presented in FIG. 2. In this variation, a fraction of the hydrogen coming from the separation section SI via line 8 is injected, without a purification treatment, into the reaction section R2 via a line 21.

Figure 3:
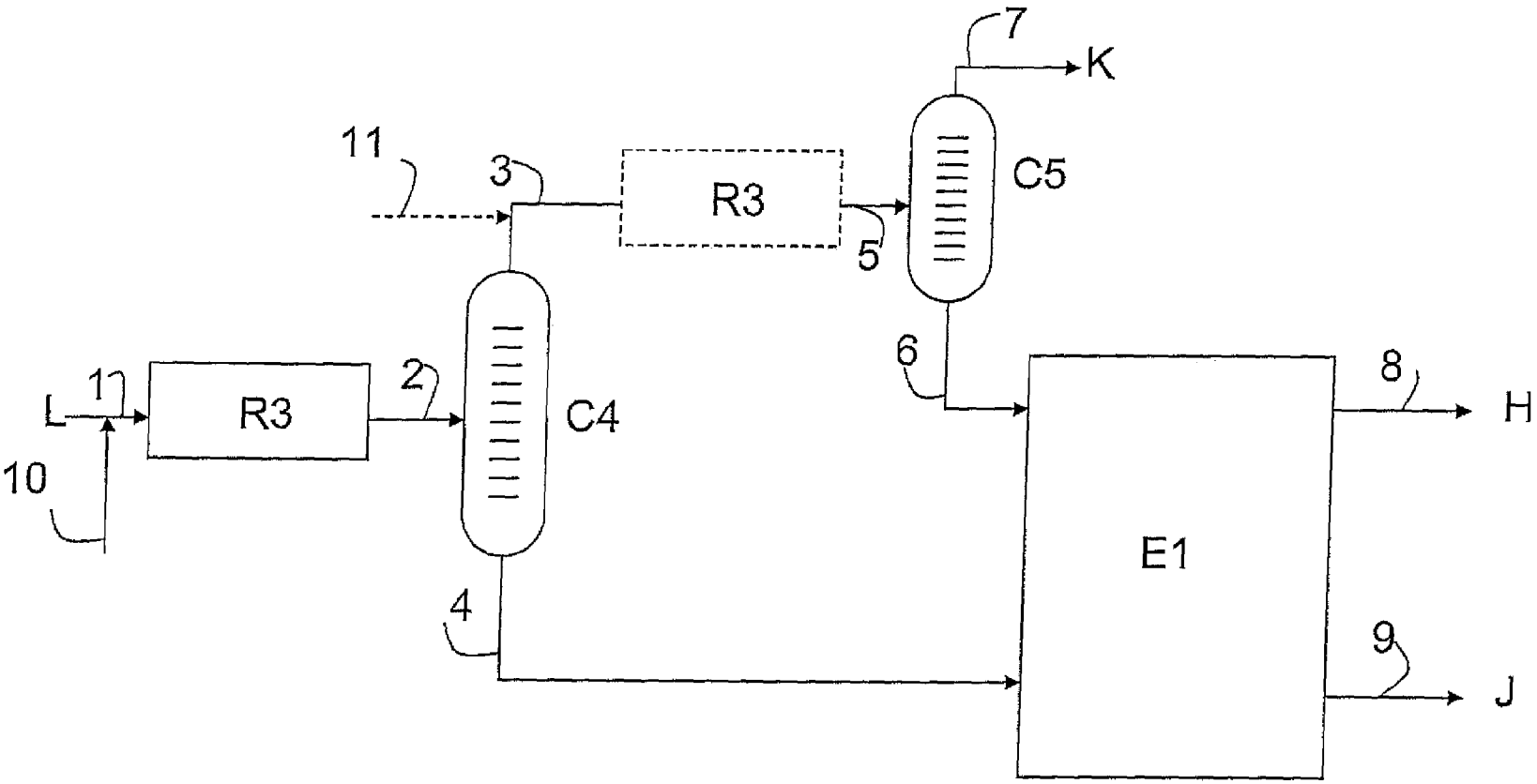

Description of FIG. 3

FIG. 3 illustrates the concatenations of the pre-treatment step principally consisting of hydrogenating diolefins, transforming the light sulphur-containing compounds into heavier compounds and the selective hydrodesulphurization step.

The pre-treatment step R3 may be carried out either on the total gasoline injected via line 1 or on the gasoline recovered overhead via line 3 from distillation column C4. In the latter case, the gasoline A is sent directly to column C4 without pre-treatment.

When the pre-treatment is applied to all of the gasoline, hydrogen is injected via a line 10 upstream of the pre-treatment step R3 which corresponds to the step for selective hydrogenation and transforming the light saturated sulphur-containing compounds into heavier compounds. The gasoline produced is then distilled into two cuts in column C4—a heavy cut extracted via line 4 which corresponds to the heavy gasoline described in the text, and a lighter fraction recovered via line 3 which corresponds to the mixture of the core gasoline and the light gasoline described in the text. The light fraction is then distilled in a second column, C5, which can separate the core gasoline which leaves via line 6 from the light gasoline which exits via line 7. The light gasoline recovered via line 7 is generally depleted in sulphur and may be sent directly to the gasoline pool without complementary treatment.

The core and heavy gasolines respectively recovered via lines 6 and 4 are treated in one or more hydrodesulphurization sections in accordance with the invention and can recover a gasoline H via line 8 and a gasoline J via line 9, sent respectively to the gasoline pool and to the middle distillate pool.

It may be advantageous to produce the three gasoline cuts described in a single column provided with a side stream take-off from which the core gasoline is extracted. In a further implementation of the invention, the column for distillation of all of the gasoline injected via line 1 may be a single column with an internal wall.

When the pre-treatment step R3 is applied to the gasoline from line 3, hydrogen is injected via line 11. This implementation has the advantage of sending to the pre-treatment step R3 only a fraction of the gasoline corresponding to the fraction which is depleted in heavy gasoline, which reduces the quantities of gasoline to be treated, as well as the presence of potential contaminants for said catalysts, such as arsenic or silicon, which are generally concentrated in the heavy gasoline fractions.

EXAMPLES

Preparation of feeds

A gasoline a the boiling points of which were in the range 6° C. to 236° C., derived from a catalytic cracking unit, was distilled in a batch distillation column to produce four cuts:

A cut a1 corresponding to the 6° C.-188° C. fraction;

A cut a2 corresponding to the 188° C.-236° C. fraction;

A cut a3 corresponding to the 6° C.-209° C. fraction;

A cut a4 corresponding to the 209° C.-236° C. fraction.

The characteristics of the various cuts are shown in Table 1.

TABLE 1

| | | characteristics of distilled cuts | | | | |
|---|---|---|---|---|---|---|
| | | a 100% | a1 85% | a2 15% | a3 92% | a4 8% |
| S | ppm by weight | 390 | 253 | 1173 | 250 | 1875 |
| BrN | g/100 g | 41 | 46.5 | 11 | 43 | 6 |
| RON | | 91.7 | 91.5 | 94.5 | 92.1 | 94.3 |
| MON | | 80 | 81.3 | 82.8 | 81.9 | 82.9 |
| Cut | ° C. | 6-236 | 6-188 | 188-235 | 6-209 | 209-235 |

ppm by weight is the weight of sulphur in parts per million, measured using the ASTM D-5453 method;
BrN (bromine number) is the bromine number, measured using the ASTM D-1159 method.

Example 1 (Comparative)

A volume of 100 ml of catalyst HR806S (sulphur-containing catalyst based on cobalt and molybdenum) sold by Axens was loaded into the reactor of a pilot unit. That catalyst had the ability of being pre-sulphurized and pre-activated ex situ. Thus, there was no need for a complementary sulphurization step.

Gasoline a was mixed with hydrogen before being injected into the reactor. The gasoline flow rate was 400 ml/h and the hydrogen flow rate was 116 normal litres of hydrogen per hour. The hydrogen flow rate was such that the ratio $H_2$/HC in normal litres of hydrogen per litre of feed was 290 Nl/l. The temperature was adjusted to 260° C. and the pressure was 2 MPa. The gasoline produced, termed c1, was cooled and stripped by a stream of hydrogen to eliminate dissolved $H_2S$.

After analysis, this gasoline contained 38 ppm of sulphur including 14.0 ppm in the form of mercaptans. Its research octane number (RON) was 90.60 and its motor octane number (MON) was 79.40.

Example 2 (in accordance with the invention)

340 ml/h of gasoline a1 was mixed with 98 normal litres per hour of hydrogen and injected into a volume of 85 ml of HR806S catalyst. The hydrogen flow rate was such that the ratio $H_2$/HC, in normal litres of hydrogen per litre of feed, was 300 Nl/l. The temperature of the reactor was adjusted to 260° C. and the pressure was adjusted to 2 MPa. The gasoline produced, denoted b1, contained 19 ppm of sulphur including 8 ppm in the form of mercaptans.

60 ml/h of gasoline a2 was mixed with 14.4 normal litres per hour of hydrogen and injected onto a volume of 15 ml of HR806S catalyst. The hydrogen flow rate was such that the ratio $H_2$/HC, in normal litres of hydrogen per litre of feed, was 240 Nl/l. The reactor temperature was adjusted to 260° C. and the pressure was adjusted to 2 MPa. The gasoline produced, denoted b2, contained 90 ppm of sulphur including 4 ppm in the form of mercaptans.

Overall, to treat cuts al and a2, the hydrogen flow rate was such that the ratio $H_2$/HC, in normal litres of hydrogen per litre of feed, was 290 Nl/l.

Gasolines bl and b2 were mixed in amounts of 85% by weight of gasoline b1 and 15% by weight of gasoline b2. The mixture so constituted, denoted c2, was analyzed. It contained 30 ppm of sulphur including 8.0 ppm in the form of mercaptans. Its research octane number (RON) was 90.80 and its motor octane number (MON) was 79.50. The fraction b2 could also be sent to the middle distillate pool with a very low sulphur content.

Comparing gasolines c1 and c2 produced in examples 1 and 2, it appears that treatment in parallel of gasolines separated into two distinct cuts while maintaining overall the same flow rate of hydrogen can improve the octane number of the desulphurized gasoline and especially significantly reduce the amount of mercaptans.

Example 3 (in accordance with the invention)

Gasoline b1 was obtained using the preparation method described in Example 2.

60 ml/h of gasoline a2 was mixed with 6.3 normal litres per hour of hydrogen and injected onto a volume of 15 ml of HR806S catalyst. The hydrogen flow rate was such that the ratio $H_2$/HC, in normal litres of hydrogen per litre of feed, was 105 Nl/l. The reactor temperature was adjusted to 260° C. and the pressure was adjusted to 2 MPa. The gasoline produced, denoted b5, contained 135 ppm of sulphur including 6 ppm in the form of mercaptans.

Gasolines b1 and b5 were mixed in amounts of 85% by weight of gasoline b1 and 15% by weight of gasoline b5. The mixture so constituted, denoted c4, was analyzed. It contained 36 ppm of sulphur including 8.0 ppm in the form of mercaptans. Its research octane number (RON) was 90.90 and its motor octane number (MON) was 79.60. The fraction b5 could also be sent to the middle distillate pool with a very low sulphur content.

Overall, to treat cuts a1 and a2, the hydrogen flow rate was such that the ratio $H_2$/HC, in normal litres of hydrogen per litre of feed, was 270 Nl/l.

Example 4 (in accordance with the invention)

368 ml/h of gasoline a3 was mixed with 108.2 normal litres per hour of hydrogen and injected onto a volume of 92 ml of HR806S catalyst. The hydrogen flow rate was such that the ratio $H_2$/HC, in normal litres of hydrogen per litre of feed, was 294 Nl/l. The reactor temperature was adjusted to 260° C. The gasoline produced, denoted b3, contained 20 ppm of sulphur including 7 ppm in the form of mercaptans.

32 ml/h of gasoline a4 was mixed with 7.5 normal litres per hour of hydrogen and injected onto a volume of 8 ml of HR806S catalyst. The hydrogen flow rate was such that the ratio $H_2$/HC, in normal litres of hydrogen per litre of feed, was 234 Nl/l.

The reactor temperature was adjusted to 260° C. The gasoline produced, denoted b4, contained 140 ppm of sulphur including 3 ppm in the form of mercaptans.

Gasolines b3 and b4 were mixed in amounts of 92% by weight of gasoline b3 and 8% by weight of gasoline b4. The mixture so constituted, termed c3, was analyzed. It contained 30 ppm of sulphur including 7.0 ppm in the form of mercaptans. Its research octane number (RON) was 91.00 and its motor octane number (MON) was 79.70. Fraction b4 could also be sent to the middle distillate pool with a very low sulphur content.

Overall, to treat cuts a3 and a4, the hydrogen flow rate was such that the ratio $H_2$/HC, in normal litres of hydrogen per litre of feed, was 290 Nl/l.

Comparing Examples 2 and 4, it is clear that it is advantageous to separate from the gasoline a heavy fraction with a boiling point of more than 209° C. to treat it in an independent hydrodesulphurization section, as this can improve the octane number of the desulphurized gasoline and to reduce the amount of mercaptans.

Example 5 (comparative)

340 ml/h of gasoline a1 was mixed with 98.6 normal litres per hour of hydrogen and injected onto a volume of 85 ml of HR806S catalyst. The hydrogen flow rate was such that the ratio $H_2$/HC, in normal litres of hydrogen per litre of feed, was 290 Nl/l. The reactor temperature was adjusted to 260° C. and the pressure was adjusted to 2 MPa. The gasoline produced, denoted b6, contained 22 ppm of sulphur including 9 ppm in the form of mercaptans.

60 ml/h of gasoline a2 was mixed with 17.4 normal litres per hour of hydrogen and injected onto a volume of 15 ml of HR806S catalyst. The hydrogen flow rate was such that the ratio $H_2$/HC, in normal litres of hydrogen per litre of feed, was 290 Nl/l. The reactor temperature was adjusted to 260° C. and the pressure was adjusted to 2 MPa. The gasoline produced, denoted b7, contained 80 ppm of sulphur including 4 ppm in the form of mercaptans.

Overall, to treat cuts al and a2, the hydrogen flow rate was such that the ratio $H_2$/HC, in normal litres of hydrogen per litre of feed, was 290 Nl/l.

Gasolines b6 and b7 were mixed in amounts of 85% by weight of gasoline b6 and 15% by weight of gasoline b7. The mixture so constituted, termed c5, was analyzed. It contained 31 ppm of sulphur including 8.3 ppm in the form of mercaptans. Its research octane number (RON) was 90.65 and its motor octane number (MON) was 79.40.

TABLE 2

Comparison of performances obtained

| Example | 1 comparative | 2 invention | 3 invention | 4 invention | 5 comparative |
|---|---|---|---|---|---|
| Cut point (° C.) | No | 188 | 188 | 209 | 188 |
| $H_2$/HC (HDS2) compared with $H_2$/HC (HDS1), % | No | 80 | 35 | 80 | 100 |
| Amount of sulphur | 38 | 30 | 36 | 30 | 31 |

TABLE 2-continued

| Comparison of performances obtained | | | | | |
|---|---|---|---|---|---|
| Example | 1 comparative | 2 invention | 3 invention | 4 invention | 5 comparative |
| (ppm) | | | | | |
| Amount of mercaptans (ppm) | 14.0 | 8.0 | 8.0 | 7.0 | 8.3 |
| RON | 90.60 | 90.80 | 90.90 | 91.00 | 90.65 |
| MON | 79.40 | 79.50 | 79.60 | 79.70 | 79.40 |

$H_2$/HC (HDS2) compared with $H_2$/HC (HDS1), %: ratio between the flow rate of hydrogen, expressed in normal $m^3$ per hour and the flow rate of the feed to be treated, expressed in $m^3$ per hour, under standard conditions as a percentage of the ratio of the flow rates employed for desulphurization in the hydrodesulphurization step HDS1.

A comparison of Examples 1, 2, 4 and 5 shows that the parallel treatment of gasolines separated into two distinct cuts while maintaining overall the same hydrogen flow rate can improve the octane number of the desulphurized gasoline, and especially significantly reduce the amounts of sulphur and mercaptans.

Further, when the hydrogen flow rate in the hydrodesulphurization step HDS2 is such that the ratio between the hydrogen flow rate, expressed in normal $m^3$ per hour, and the flow rate of the feed to be treated, expressed in $m^3$ per hour under standard conditions, is less than 80% of the ratio of the flow rates employed for desulphurization in the hydrodesulphurization step HDS1 (Examples 2 and 4 of the invention), a significant reduction in the amounts of sulphur and mercaptans is envisaged for high RON and MON octane numbers.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French application No. 06/03.630, filed Apr. 24, 2006, is incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for producing gasolines with a low sulphur and mercaptans content, comprising treating a feed in at least two hydrodesulphurizations HDS1 and HDS2 operated in parallel on two distinct cuts of a gasoline feed, the feed corresponding to a gasoline from a catalytic cracking unit distilled into three fractions:

a light fraction corresponding to a gasoline fraction with a boiling point of less than 100° C.;

a heavy gasoline fraction corresponding to a gasoline fraction with a boiling point of more than 180° C.;

a core fraction corresponding to an intermediate fraction between the light fraction and the heavy fraction;

wherein hydrodesulphurization HDS2 has a flow rate of hydrogen such that the ratio between the flow rate of hydrogen, expressed in normal $m^3$ per hour, and the flow rate of feed to be treated, expressed in $m^3$ per hour, under standard conditions, is less than 80% of the ratio of the flow rates employed for desulphurization in hydrodesulphurization HDS1, and wherein a mixture constituted by the light gasoline fraction and the intermediate fraction or the intermediate fraction alone is treated in the hydrodesulphurization HDS1, said treatment comprising bringing the gasoline to be treated into contact with hydrogen in one or more hydrodesulphurization reactors in series containing one or more catalysts suitable for carrying out selective hydrodesulphurization with a degree of mono-olefins hydrogenation of less than 60%, and in which the heavy fraction of the gasoline is treated in hydrodesulphurization HDS2, said treatment comprising bringing the gasoline to be treated into contact with hydrogen in one or more hydrodesulphurization reactors in series containing one or more catalysts suitable for carrying out hydrodesulphurization, hydrodesulphurization being carried out selectively or non-selectively, the degree of hydrogenation of the mono-olefins being less than 90% in the case of selective hydrodesulphurization, and wherein gasoline obtained in the process has a research octane number greater than or equal to 90.70 and a sulfur content less than or equal to 50 ppm.

2. A process according to claim 1, comprising a single section for purifying and recycling excess hydrogen from hydrodesulphurizations HDS1 and HDS2.

3. A process according to claim 2, in which at least all of the hydrogen necessary for the reactions occurring in the two hydrodesulphurizations is admitted through only one of the hydrodesulphurizations and in which a gas purge from said only one hydrodesulphurization is sent to purifying treatment, purified gaseous product from which is recycled to only the other hydrodesulphurization unit.

4. A process according to claim 3, in which at least all of the hydrogen necessary for the reactions occurring in the two hydrodesulphurizations is admitted through the hydrodesulphurization HDS2.

5. A process according to claim 1, in which the flow rate of hydrogen in the hydrodesulphurization unit HDS1 is such that the ratio between the hydrogen flow rate, expressed in normal $m^3$ per hour, and the flow rate of the feed to be treated, expressed in $m^3$ per hour under standard conditions, is in the range 50 $Nm^3/m^3$ to 1000 $Nm^3/m^3$ and in which the flow rate of hydrogen in the hydrodesulphurization unit HDS2 is such that the ratio between the flow rate of hydrogen, expressed in normal $m^3$ per hour, and the flow rate of feed to be treated, expressed in $m^3$ per hour, under standard conditions is in the range 30 $Nm^3/m^3$ to 800 $Nm^3/m^3$.

6. A process according to claim 1, in which the feed is pretreated in order to:

selectively hydrogenate diolefins into mono-olefins;

transform saturated light sulphur-containing compounds into heavier sulphides or mercaptans by reaction with the mono-olefins.

7. A process according to claim 1, in which the catalyst used in the hydrodesulphurizations HDS1 and HDS2 is a catalyst or a concatenation of catalysts comprising a support, a group VI metal promoted or otherwise by a group VIII metal and with a mean pore diameter of more than 22 nm.

8. A process according to claim 1, in which the catalyst used in the hydrodesulphurizations HDS1 and HDS2 comprises an amorphous porous mineral support, at least one group VI metal and/or at least one group VIII metal, the porosity of the catalyst before sulphurization being such that it has a mean pore diameter of more than 20 nm and the specific surface area of the group VI metal is in the range $2\times10^{-4}$ to $4.0\times10^{-3}$ grams of the oxide of said metal per $m^2$ of support.

9. A process according to claim 7, in which the group VI metal is molybdenum or tungsten and the group VIII metal is nickel or cobalt.

10. A process according to claim 8, in which the group VI metal is molybdenum or tungsten and the group VIII metal is nickel or cobalt.

11. A process according to claim 1, wherein the flow rate of hydrogen in the hydrodesulphurization HDS2 is such that the ratio between the flow rate of hydrogen, expressed in normal $m^3$ per hour, and the flow rate of feed to be treated, expressed in $m^3$ per hour, under standard conditions, is less than 60% of the ratio of the flow rates employed for desulphurization in the hydrodesulphurization step HDS1.

12. A process according to claim 1, wherein the flow rate of hydrogen in the hydrodesulphurization HDS2 is such that the ratio between the flow rate of hydrogen, expressed in normal $m^3$ per hour, and the flow rate of feed to be treated, expressed in $m^3$ per hour, under standard conditions, is less than 50% of the ratio of the flow rates employed for desulphurization in the hydrodesulphurization HDS1.

13. A process according to claim 1, wherein the flow rate of hydrogen in the hydrodesulphurization HDS2 is such that the ratio between the flow rate of hydrogen, expressed in normal $m^3$ per hour, and the flow rate of feed to be treated, expressed in $m^3$ per hour, under standard conditions, is less than 40% of the ratio of the flow rates employed for desulphurization in the hydrodesulphurization HDS1.

* * * * *